US005438316A

United States Patent [19]

Motsinger et al.

[11] Patent Number: 5,438,316

[45] Date of Patent: Aug. 1, 1995

[54] FENCE ALARM SYSTEM WITH SWIVELING POSTS

[75] Inventors: James V. Motsinger, Round Rock; Michael P. Coppo, Austin, both of Tex.

[73] Assignee: Detek Security Systems, Inc., Vestal, N.Y.

[21] Appl. No.: 787,046

[22] Filed: Nov. 4, 1991

[51] Int. Cl.[6] ..... G08B 13/00

[52] U.S. Cl. ..... 340/541; 340/550; 340/666

[58] Field of Search ..... 340/541, 665, 668, 564, 340/666, 550; 256/10–12, 32, 35–36, 47; 403/122, 144; 285/261, 272

[56] References Cited

U.S. PATENT DOCUMENTS

| | | | |
|---|---|---|---|
| 3,693,940 | 9/1972 | Kendall et al. | 256/1 |
| 4,349,989 | 9/1982 | Snider, Jr. | 47/33 |
| 4,695,677 | 9/1987 | Ruth et al. | 340/564 X |
| 4,768,020 | 8/1988 | Chen | 340/567 |
| 4,815,889 | 3/1989 | Duckett | 404/6 |
| 4,829,286 | 5/1989 | Zvi | 340/541 |
| 4,923,176 | 5/1990 | Heinz | 256/65 |
| 5,220,308 | 6/1993 | Batzdorff et al. | 340/573 |

FOREIGN PATENT DOCUMENTS

| | | | |
|---|---|---|---|
| 0169763 | 1/1986 | European Pat. Off. | 340/550 |
| 0363625 | 4/1990 | European Pat. Off. | 340/550 |
| 2579350 | 9/1986 | France | 340/550 |
| 0675030 | 8/1990 | Liechtenstein | 340/541 |
| 1418458 | 8/1988 | U.S.S.R. | 256/32 |

*Primary Examiner*—Brent Swarthout
*Assistant Examiner*—Thomas J. Mullen, Jr.
*Attorney, Agent, or Firm*—Vinson & Elkins

[57] ABSTRACT

A wire fence alarm system 10 comprises a plurality of zones in which a wire or set of wires is stretched between two anchor posts. A sensing post includes sensors for detecting deflection of one of the wires and a processor for generating alarms responsive to signals from the sensors. One or more of the anchor posts comprise rotating members attached to the wires. Use of the anchor post to climb the fence will result in an imbalance in the forces applied to the rotating members by the wires, thereby initiating an alarm condition.

16 Claims, 4 Drawing Sheets

FENCE ALARM SYSTEM WITH SWIVELING POSTS

TECHNICAL FIELD OF THE INVENTION

This invention relates in general to security devices, and more particularly to a taut wire fence alarm system.

BACKGROUND OF THE INVENTION

A taut wire fence alarm system utilizes one or more wires stretched across an opening such that the intruder must move or disturb the wire to gain entry into the secured location. Detection circuitry is coupled to the taut wires to detect a deflection of one or more of the wires. The detecting circuitry must be able to distinguish movements in the wires due to an intruder from other movements in the wires, such as movements caused by wind or by small animals. Furthermore, the structure supporting the taut wire must prevent an intruder from overcoming the fence without disturbing the wires.

Taut wire fence alarm systems use anchor posts between which the taut wires are strung. One area of the fence which is particularly difficult to protect from an intruder's climbing is the corner anchor post. One method of preventing an intruder from using the corner anchor post to negotiate the fence is to extend the fence at least five feet past the corner in each direction. In this case, even if an intruder can climb the anchor post, the intruder will still be five feet from the secured area. The disadvantage of this method is that a large amount of real estate may be wasted because of the additional real estate required to extend the fence. Also, this method requires the installation of two posts.

A second method is to use breakaway tabs to secure the wire to the corner anchor post. Using this method, the tabs break under an intruder's weight thereby causing a deflection of the associated wire. This method, however, is only effective when the secure area is outside the corner, i.e., the corner must turn around the threat area.

Another problem associated with prior art taut wire fence alarm system concerns the use of angles within a zone. The fence comprises a plurality of zones, each zone having two anchor posts at the endpoints of the zone and a sensing post located between the anchor posts, typically in the middle. A number of intermediate posts help to support the weight of the wires. The sensing post contains a number of electronic components, and is therefore relatively expensive. Thus, it is desirable to minimize the number of zones.

In the prior art, formation of a non-linear zone, i.e., a zone including one or more angles, was problematic. Angles of greater than fifteen degrees were impossible to achieve at an intermediate post because of the friction occurring between the wires and the loops through which the angle was formed. Friction at angles of greater than fifteen degrees significantly impedes translation movement of the wires. Since translational movement of the wires is important to detection, friction with the wires must be minimized.

Therefore, a need has arisen in the industry for a method and apparatus for providing a fence alarm system with secure anchor posts to efficiently and accurately monitor a secured area.

SUMMARY OF THE INVENTION

In accordance with the present invention, a wire fence alarm system and method is provided which substantially solves the problems associated with prior wire fence alarm systems.

In the present invention, a fence alarm system comprises a plurality of posts, coupled to one or more wires. Detecting circuitry is provided for detecting the application of a force to one of the wires. At least one of the posts includes a rotatable member, such that an attempt to climb the causes a force to be applied to the rotatable member, thereby deflecting the wires coupled thereto.

The present invention provides significant advantages over the prior art. First, real estate is not wasted, since the rotatable anchor post does not require any extended portions. Second, the corner anchor post may be used to corner both secure and threat areas. Third, the present invention may be used as intermediate posts to effect angles within a zone.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–5 of the drawings, like numerals being used for like and corresponding parts of the various drawings.

Figure 1:
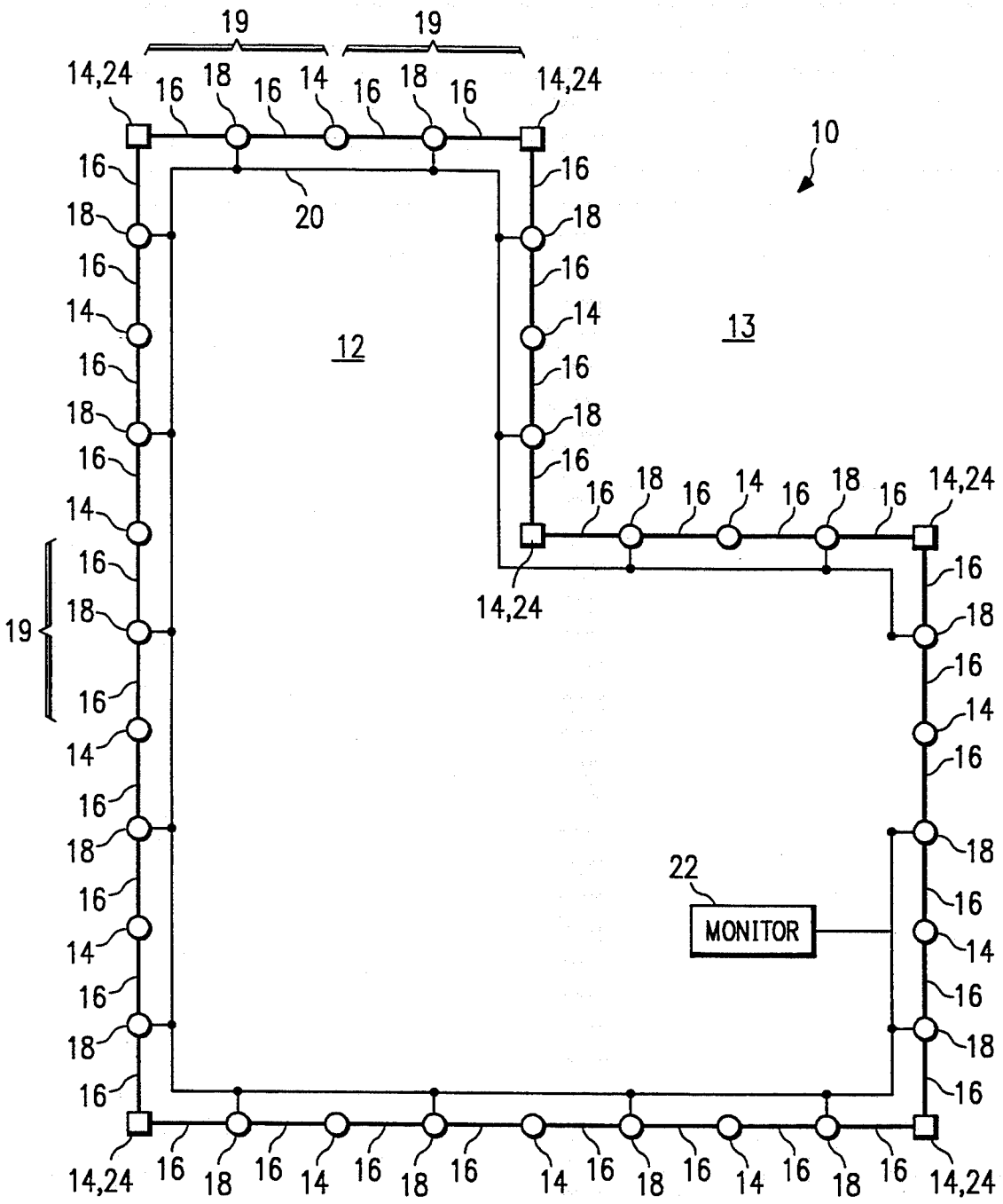
FIG. 1 illustrates a block diagram of a taut wire fence alarm system.

FIG. 1 illustrates a block diagram of a taut wire fence alarm system. The taut wire fence 10 surrounds a "secure" area 12 and is surrounded by "threat" area 13. The "secure" side of the wire fence 10 is the side which does not pose a threat of someone climbing the wire fence 10; the threat side is the side where someone may attempt to climb the fence. Secure area 12 may be the real estate surrounded by the wire fence 10 or the area outside of the wire fence 10; for purposes of illustration, FIG. 1 assumes that the secure area 12 is enclosed by the wire fence 10. The wire fence 10 comprises a plurality of anchor posts 14, between which one or more wires 16 are strung and maintained at a predetermined tension using tensioners (not shown). Sensor posts 18 are placed intermediate to anchor posts. A "zone" 19 comprises two anchor posts 14 and a sensor post 18. Generally, a zone is no more than 110 yards in length. Intermediate posts (not shown) are placed every ten feet to support the weight of the wires 16.

In the preferred embodiment, each sensor post contains one or more sensors and is generally located at or near the center of a protected zone 19. Each sensor on the sensor post corresponds to one of the wires 16 strung between the two anchor posts. The sensor posts also include a processor which continually scans each sensor. The sensors on the sensing post 18 output a signal which is converted from analog-to-digital binary code and is processed by the processor. In the case of the deflection of a wire, the chronology and magnitude of the measured voltages are evaluated. The value determined to be the cause of the alarm is the difference between the measured value of the sensor and the stored reference value. If this parameter is exceeded and verified, the processor will indicate an alarm condition which is output to the data bus 20. A monitor 22 monitors the data bus 20 for alarm conditions and performs actions responsive thereto.

The anchor posts 14 are particularly important to the operation of the wire fence 10. If not properly designed, an intruder could use the anchor posts as a means of climbing the fence without disturbing the wires 16. Of particular importance are the corner anchor posts 24.

Figure 2A:
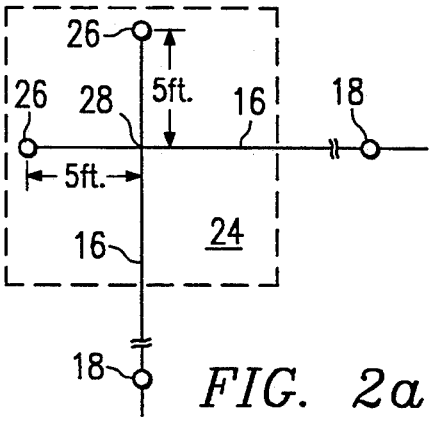
FIG. 2a (PRIOR ART)
FIG. 2*a* illustrates a first prior art structure for providing a corner anchor post.

Prior art solutions to protecting the corner anchor posts 24 have proven inadequate for a variety of reasons. FIG. 2*a* illustrates a first structure for providing a corner anchor post. In this prior art solution, two post members 26 are used to anchor a corresponding set of wires forming the sides of the corner. Each post member 26 is positioned at least five feet from the intersection of the two wires which forms the corner. The distance between the post members 26 and the intersection 28 hinders the ability of an intruder to get within the secured area after having climbed a post member 26. The likelihood that a post member could be used to an intruder's advantage may be reduced by increasing the distance between the post members 26 and the intersection 28.

The solution described in connection with FIG. 2*a* has a serious drawback, however, =since a large amount of real estate may be wasted to provide the safety zone. Also, two posts are needed, adding to the expense.

Figure 2B:
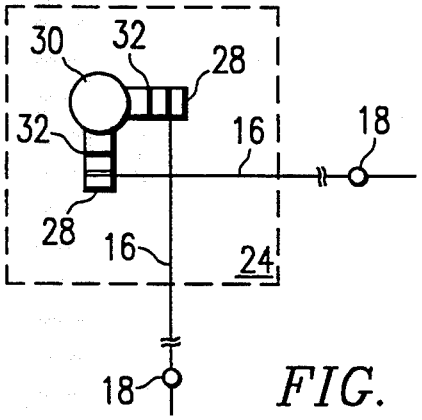
FIG. 2b (PRIOR ART)
FIG. 2*b* illustrates a second prior art structure for providing a corner anchor post.

A second method of providing a corner anchor post is shown in FIG. 2*b*. Breakaway tabs 28 extend from a post member 30, and the wires 16 are attached to the breakaway tab 28. A groove 32 is formed in the breakaway tab 28 to weaken the tab in the vertical direction.

In operation, an intruder who attempts to use the tabs 28 to climb the fence will severely bend or break a tab 28, since the groove 32 weakens the tab 28 with relation to a downward force.

Figure 3:
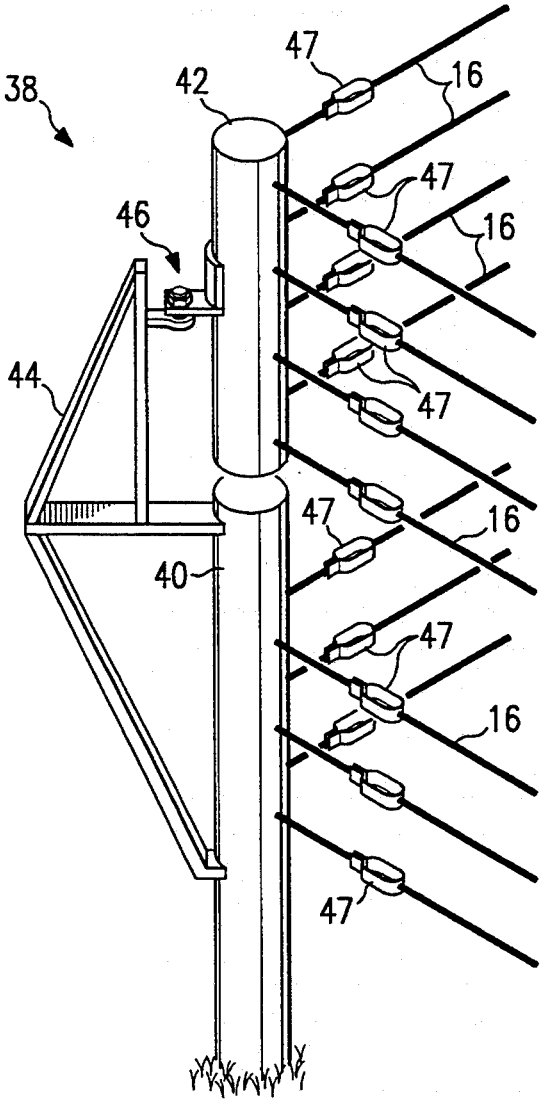
FIG. 3 illustrates a perspective view of a first embodiment of a rotating corner anchor post as provided by the present invention.
Figure 4:
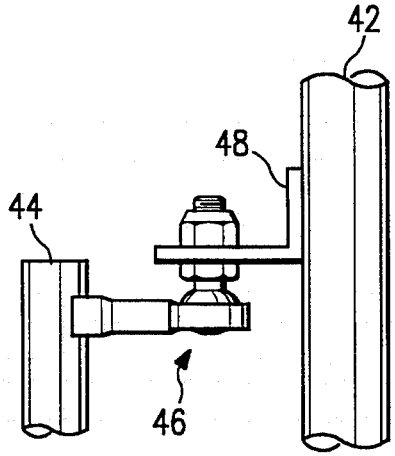
FIG. 4 illustrates a detailed view of the rotating mechanism of FIG. 3.

FIGS. 3 and 4 illustrate a preferred embodiment of a anchor post 38 which substantially overcomes the problems associated with the prior art anchor posts. The anchor post 38 comprises two post members 40 and 42. A truss 44 is fixedly coupled to the first post member 40 and is further coupled to the second post member 42 by a swiveling mechanism 46. The swiveling mechanism 46 is discussed in greater detail in connection FIG. 4. The wires 16 and tensioners 47 are coupled to the second post member 42 both above and below the swiveling mechanism 46. Hence, the forces exerted by the tension in the wires 16 offset one another such that the second post 42 remains upright during normal operation. However, if an intruder attempts to overcome the fence by climbing on the second post member 42, the intruder's weight will cause an imbalance in forces applied to the second post member 42, thereby causing a deflection in the wires 16 which may be detected by a sensing post 18.

While a truss 44 is shown as coupling post members 40 and 42 together, a simpler structure may be formed by using a C-channel bar welded to the first post. The C-channel provides sufficient clearance to attach the swiveling mechanism to the second post 42.

It should be noted that the swiveling post of FIG. 3 overcomes the problems associated by the prior art, in that additional real estate is not required and that the post 38 may provide a corner around either the secure area 12 of the threat area 13. The truss 44 is always placed on the secure area for maximum protection.

Figure 6:
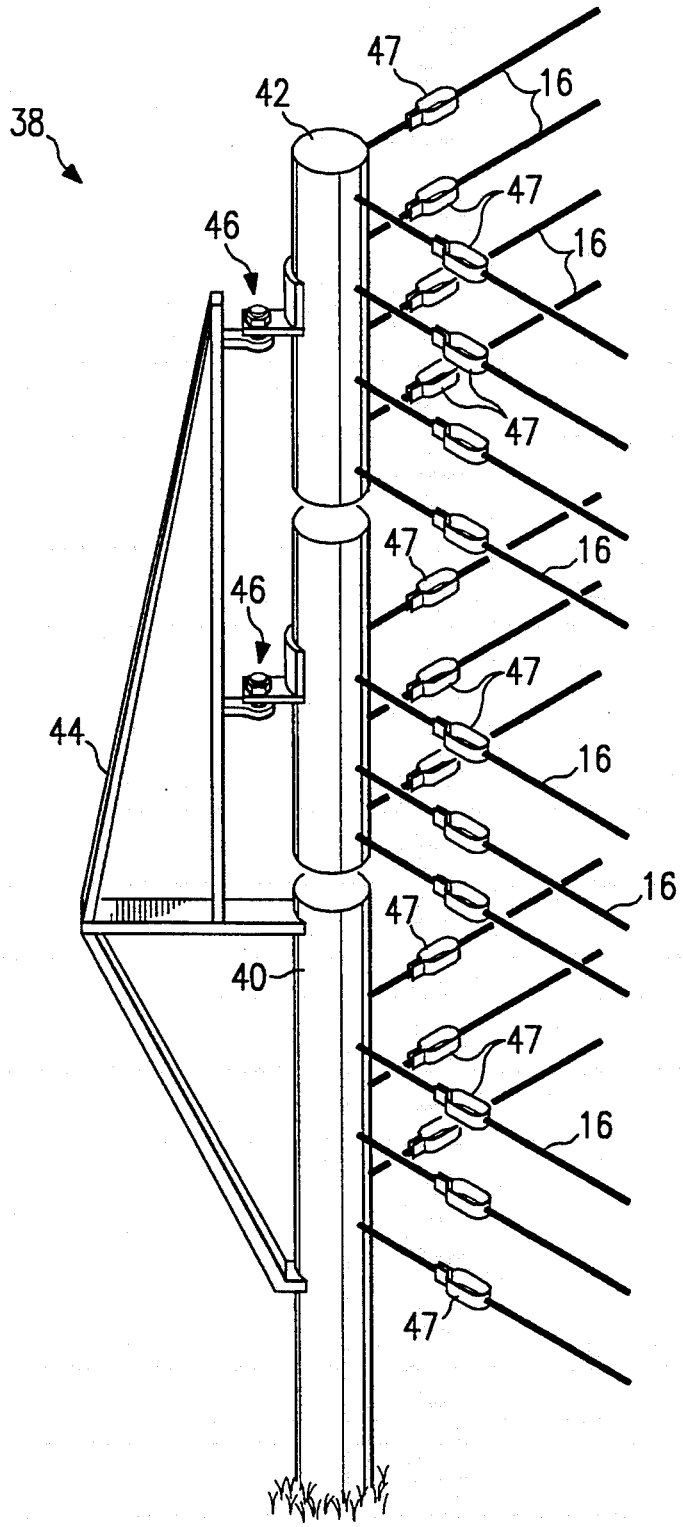
FIG. 6 illustrates an alternative embodiment of the corner anchor post of FIG. 3.

In another embodiment of FIG. 3, multiple rotating post members, characterized by swiveling mechanism 46 and post 42 may be attached to a single fixed post or truss as shown in FIG. 6. This embodiment if particularly effective where each zone comprises a large number of wires.

FIG. 4 illustrates a detailed view of the swiveling mechanism 46. The swivel joint is available as Part No. BRE-825 from Buyres Product Co. of Mentor, Ohio; other functionally equivalent swivel joints are also suitable. The swivel joint 46 is preferably rotatable in any direction around an axis point. The swivel joint may be coupled to the second post 42 by means of an "L" bracket 48 which is welded to the second post member 42.

The anchor post 38 of FIG. 3 may be designed to work with existing taut wire fence alarm systems. In this embodiment, the first post member 40 is designed such that it may slide over an existing post member. The first post member 40 can then be welded to the existing post member.

Figure 5A:
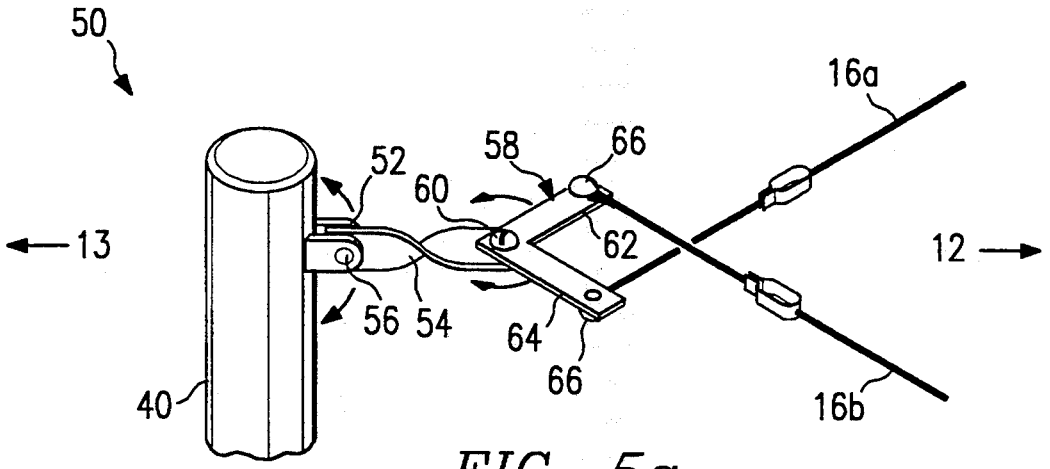
FIGS. 5*a–c* illustrate a second embodiment of a rotating corner anchor post as provided by the present invention.
Figure 5B:
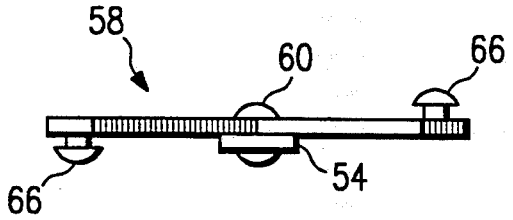
Figure 5C:
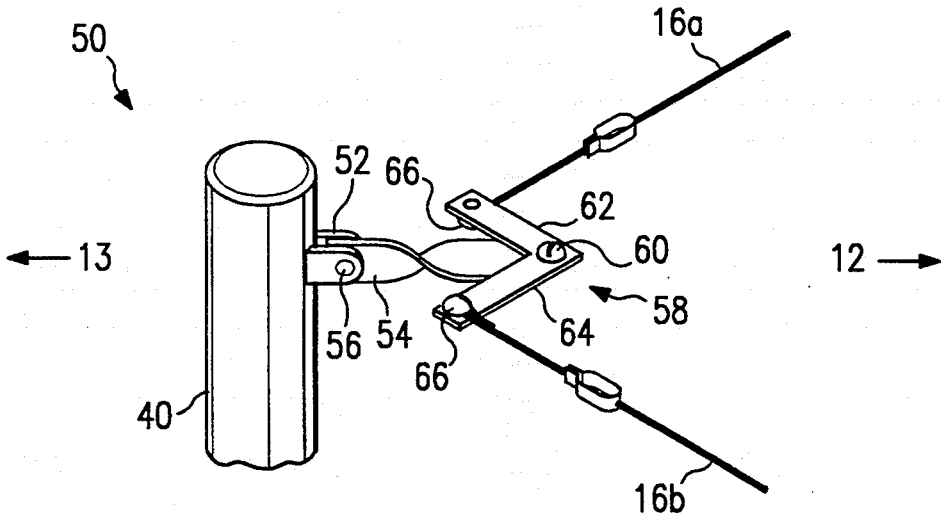

FIGS. 5*a–c* illustrate a second embodiment 50 of a corner post 24 which is also particularly suited to use as an intermediate post for effecting an angle. This embodiment uses a single post member 40 having an attached bracket 52. First rotating member 54 is coupled to bracket 52 such that it may rotate in a vertical plane. Rotating member 54 is twisted such that the end not attached to bracket 52 is substantially horizontally aligned. Second rotating member 58 is coupled to the free end of rotating member 54 such that it may rotate in a horizontal plane about pivot point 60. Second rotating member 58 has arms 62 and 64 forming a right angle. Wires 16 are attached perpendicular to the arms 62 and 64 on attachment points 66.

As previously discussed, effectuating an angle within a zone has been difficult in the prior art. Consequently, inefficient zone structures have been used to handle situations where an angle is necessary, such as surrounding a small antenna, or avoiding a structure interrupting a straight zone, such as a tree. For example, in the prior art, to surround a small antenna, four zones would be required, even if the total length of the zone was less than 110 yards (the maximum zone length). Therefore, four sensors would be required. As described below, the present invention allows for intermediate angles and thereby reduces the zones required under certain situations.

In operation, a force applied to one wire 16*a* attached to the second rotating member 58 will be translated to the other wire 16*b* attached to the second rotating member 58. Thus, a sensor post coupled to the wires on one side of post 50 can detect forces applied to wires on the other side of post 50. In fact, a sensor post may detect motions on the wires caused by forces applied to wires which are separated from the sensor post by two or more posts 50, thereby allowing multiple intermediate angles, angles within a single zone.

It should be noted that while the post shown in FIGS. 5*a–c* provides for ninety degree angles, other angles could be similarly provided.

Further, the posts shown in FIGS. 5*a–c* can be used with the post 40 on the threat side of the fence if multiple rotating members 58 are vertically aligned to provide counterbalancing forces.

The rotating post of FIG. 5*a* may also be used as a corner anchor post. In this embodiment, the two rotating members 54 and 58 will remain stationary under normal conditions due to the counteracting forces applied by the wire 16. However, the anchor post 50 cannot be used by an intruder from the threat side 12 since the weight of the intruder will offset the forces and thereby deflect the wires.

FIG. 5*b* illustrates a front view of the second rotating member 58, showing attachment points 66 for the wire 16. One attachment point 66 is placed above the horizontal plane defined by the second rotating member 58 and one is placed below the horizontal plane. Hence, the wires attached to the attachment point 66 will be vertically separated to avoid friction between the two wires.

FIG. 5*c* illustrates another embodiment of the invention for providing an corner anchor post or an intermediate angle post. In this embodiment, the second rotating member 58 is rotated 180° about pivot point 60. The wires 16 are once again attached perpendicular to the arms 62 and 64. In this embodiment, friction between wires 16*a–b* is not a factor.

It should be noted that for minimum friction effects maximum security, the length of the arms 62 and 64 in FIGS. 5*a–c* should be long relative to the diameter of the pivot axle 60.

Although the present invention and its advantages have been described in detail, it should be understood that various changes, substitutions and alterations can be made herein without departing from the spirit and scope of the invention as defined by the appended claims.

What is claimed is:

1. A fence alarm system comprising:

a plurality of wires;

force detection circuitry responsive to the application of a force to one or more of said wires; and a plurality of posts coupled to said wires, at least one of said posts having an associated rotating member for rotating in a plurality of planes coupled to at least two wires such that said rotating member is maintained in a predetermined position by said wires in the absence of an external force and is offset from said predetermined position in at least one of said plurality of planes responsive to an external force applied to the rotating member.

2. The fence alarm of claim 1 wherein at least one of said one or more posts having an associated rotating member comprises:

a first post member;

a second post member; and a swivel joint coupled between said first post member and said second post member, such that a force applied to said second post member causes rotation thereof.

3. The fence alarm system of claim 2 wherein said first post member is secured to the ground.

4. The fence alarm system of claim 3 wherein said first post member mates with a third post member.

5. The fence alarm system of claim 2 and further comprising a structure coupling said swivel joint to said first post member.

6. The fence alarm system of claim 1 wherein said rotating member comprises:

a pivot arm;

a coupling member coupled between said pivot arm and a post associated with the rotating member for rotating responsive to a force applied to said pivot arm; and means for coupling one or more wires to the pivot arm.

7. The fence alarm system of claim 6 wherein said pivot arm comprises a first pivoting member coupled to the associated post for rotating in a first plane responsive to the external force and a second pivoting member coupled to said first pivoting member for rotating in a second plane responsive to the external force.

8. The fence alarm system of claim 7 wherein said first and second pivoting members rotate in planes orthogonal to each other.

9. The fence alarm system of claim 6 wherein said wire coupling means is provides a vertical displacement between said first and second wires.

10. The fence alarm system of claim 1 wherein said force detecting circuitry comprises sensors for measuring the deflection of respective wires and a processor for generating an alarm responsive to said sensors.

11. A post for use in a fence alarm system comprising:

a post member;

a pivot arm for rotating in a plurality of planes;

a coupling member coupled between said pivot arm and said post member for rotating in at least one of said planes responsive to a force applied to said pivot arm; and means for coupling first and second wires to the pivot arm such that a force applied to said first wire is translated to said second wire.

12. The post of claim 11 wherein said pivot arm comprises a first pivoting member coupled to the associated post for rotating in a first plane responsive to the external force and a second pivoting member coupled to said first pivoting member for rotating in a second plane responsive to the external force.

13. The post of claim 12 wherein said first and second pivoting members rotate in planes orthogonal to each other.

14. The post of claim 11 wherein said wire coupling means provides a vertical displacement between said first and second wires.

15. A fence alarm system comprising:

a plurality of wires;

force detection circuitry for generating an alarm responsive to movement of one or more of said wires, said force detection circuitry comprising sensors for measuring the deflection of respective wires and a processor for generating an alarm responsive to said sensors; and a plurality of posts coupled to said wires, at least one of said posts coupled to a rotating member for rotating in a plurality of planes such that an intrusive force on the rotating member causes movement of at least one of said wires to generate an alarm.

16. A fence alarm system comprising:

a plurality of wires;

force detection circuitry responsive to the application of a force to one or more of said wires; and a plurality of posts coupled to said wires, at least one of said posts having an associated rotating member for rotating in a plurality of planes coupled to at least two wires such that said rotating member is maintained in a predetermined position by said wires in the absence of an external force and is offset from said predetermined position in at least one of said plurality of planes responsive to an external force applied to the rotating member, said rotating member comprising a first pivoting member for rotating in a first plane responsive to the external force and a second pivoting member coupled to said first pivoting member for rotating in a second plane responsive to the external force.

* * * * *